United States Patent [19]

Donnally

[11] Patent Number: 4,932,175

[45] Date of Patent: Jun. 12, 1990

[54] TELESCOPIC DRILLING DERRICK APPARATUS

[76] Inventor: Robert B. Donnally, 14806 Mesita Dr., Houston, Tex. 77083

[21] Appl. No.: 281,077

[22] Filed: Dec. 8, 1988

[51] Int. Cl.[5] ..... B66C 23/00

[52] U.S. Cl. ..... 52/118; 52/120; 52/745

[58] Field of Search ..... 52/116, 117, 118, 119, 52/120

[56] References Cited

U.S. PATENT DOCUMENTS 2,993,570 7/1961 Bender ..... 52/120 X
3,201,091 8/1965 Woolslayer ..... 52/120 X
4,134,237 1/1979 Armstrong ..... 52/118
4,269,009 5/1981 Lawrence ..... 52/120 X

FOREIGN PATENT DOCUMENTS 661517 7/1951 United Kingdom ..... 52/117

*Primary Examiner*—Carl D. Friedman
*Assistant Examiner*—Jerrold D. Johnson

[57] ABSTRACT

A telescopic drilling derrick apparatus that is light for easy transportation and utilizes structure to enable the mast to be raised from a collapsed horizontal position to a vertical position while still in an unextended position and thereafter telescopically raising the mast to full vertical height.

29 Claims, 3 Drawing Sheets

TELESCOPIC DRILLING DERRICK APPARATUS

BACKGROUND OF THE INVENTION

This invention relates to drilling derrick assemblies and more particularly relates to those drilling derrick assemblies that are portable and have masts that are to be erected for use in oil field drilling operations.

The drilling derricks or masts must be portable because they are to be used in remote locations to meet the oil field operational requirements. Such portable drilling derricks are transported with extreme difficulty and often the transportation can only be accomplished by helicopter or through the use of small trucks that are able to wend their way to the outermost reaches of desolate areas where the sites of drilling operation are often found. Thus, the mast and all the other rig components must be as light in weight as possible to meet such difficult transportation requirements, yet be erectable with a minimum of equipment and skilled personnel.

The transportation of an erected vertical mast is well known to be unfeasible and therefore these drilling masts are broken down usually through a variety of conventional methods for shipping to the location, or as nearby as practical, and thereafter erecting the mast for use. The methods chosen for erecting the mast often depend upon the size and capacity of the mast, the method of transport to be used and the equipment available at the drilling location to assist with the assembly.

The combination of minimum weight and ease of erection poses an extremely difficult problem in the art when drilling derricks are expected to be sturdy and provide sufficient support for the drilling operation. Not only does the mast pose a problem of achieving the required strength with minimum weight but also all of the erection power equipment, whether draw works or power rams, must be powerful enough to supply the force to raise the elongated mast from its horizontal, but fully elongated or set up position to the final vertical position. The torque required to raise the set up mast to the vertical position is of such magnitude that the power equipment and the substructure must be able to withstand the high forces that would be attributable to such a raising. Such sturdy and powerful equipment must inherently therefore be so very heavy that portability suffers greatly.

Telescopic drilling masts have been conventionally used in an effort to meet transportation requirements. These masts are nested within one another such as is disclosed in the patent issued to Woolslayer 2,577,642. In this patent, the masts, though shown to be transported by truck in a nesting or telescopic position must, prior to being raised, be extended by mast sections so that they may be secured together while still in a horizontal position. Thereafter the rams or draw works used to raise the elongated horizontal mast are activated to raise the elongated mast to the vertical position. Such rams or draw works would then have to overcome the very substantial torque presented by the horizontal mast, and thus would require great force necessitating the undesirable heavier and more powerful substructure and raising apparatus.

OBJECTS OF THE INVENTION

Accordingly it is the principal object of the present invention to provide a portable drilling derrick having a mast that may be erected with minimum force required.

Another object of the present invention is to provide for apparatus and method for erecting a portable mast that is telescopically shortened to minimize the torque necessary to raise the mast to a vertical position.

A further object of the present invention is the provision of apparatus and a method for telescopically receiving an upper section of a mast when the bottom section of the mast is pivoted at one end to a substructure and coupled pivotally to a guide section that holds the upper mast section for raising to the vertical position.

A further object of the present invention is to permit the addition of further mast sections to extend the height of the mast after the mast has been raised to the vertical.

A still further object of the present invention is the use of a foreshortened bottom mast section, which allows the use of less powerful and lighter raising means and which also accepts additional mast sections to extend the height of the mast after the mast has been raised to the vertical.

SUMMARY OF THE INVENTION

A telescopic drilling derrick apparatus having a substructure and a bottom mast section pivotally connected to the substructure, power means for moving the bottom mast from a horizontal position to a vertical position and an upper mast section for vertical positioning above the bottom mast section when the bottom mast is vertical, the bottom mast section being open on one side and being sized to receive or nest therewithin the upper mast section when horizontal, a guide assembly for connection to the bottom mast section which guide assembly telescopically receives therewithin the upper mast section, a support on the guide assembly in the form of a foot for securing the upper mast section for longitudinal telescopic movement within the guide assembly when it is being raised towards a vertical position, the connection between the guide assembly and the bottom mast section including a pivot positioned axially away from the lower end of the bottom mast section when in the horizontal position.

A telescopic drilling derrick apparatus permitting the use of additional mast sections to be added to the vertical mast after it has been raised having means on the apparatus to hold an upper section to the bottom mast section to permit the insertion of the lower mast section and complementary connecting means on the bottom of the upper mast section and the top of the lower mast section to be added to the vertical mast.

A method of erecting a drilling derrick apparatus having an upper mast section and a bottom mast section pivotally connected at one end to a substructure, laying the upper mast section in a horizontal position, telescopically receiving the upper mast section within a surrounding pivoting guide assembly, lowering the bottom mast section to surround a portion of the upper mast section, pivotally connecting the pivoting guide to the bottom mast section on one side while forming an acute angle between the end of the bottom mast section and the end of the upper mast section when the upper mast section is in a horizontal position, thereafter raising the bottom mast section to the vertical while decreasing the angle toward zero at a vertical position and maintaining the nesting relationship between the bottom mast and the upper mast during the raising to the vertical position and thereafter telescopically raising the upper mast section through and above the bottom mast section and securing the upper mast section to the bottom mast section to form the vertical apparatus.

DESCRIPTION OF THE PREFERRED EMBODIMENT

Figure 1:
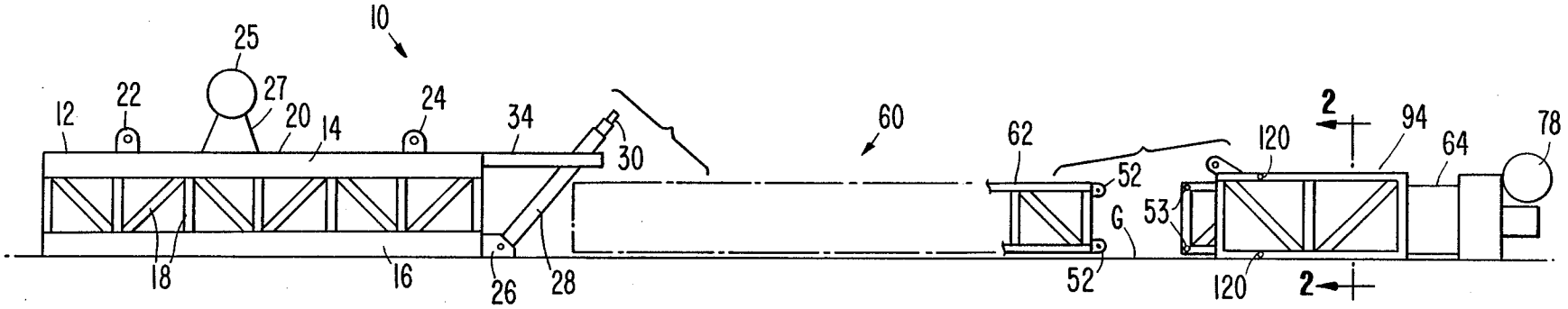
FIG. 1 is a schematic exploded view of the apparatus of the present invention partly in phantom lines illustrating the upper mast section and the pivoting guide assembly in the first position prior to assembly.
Figure 5:
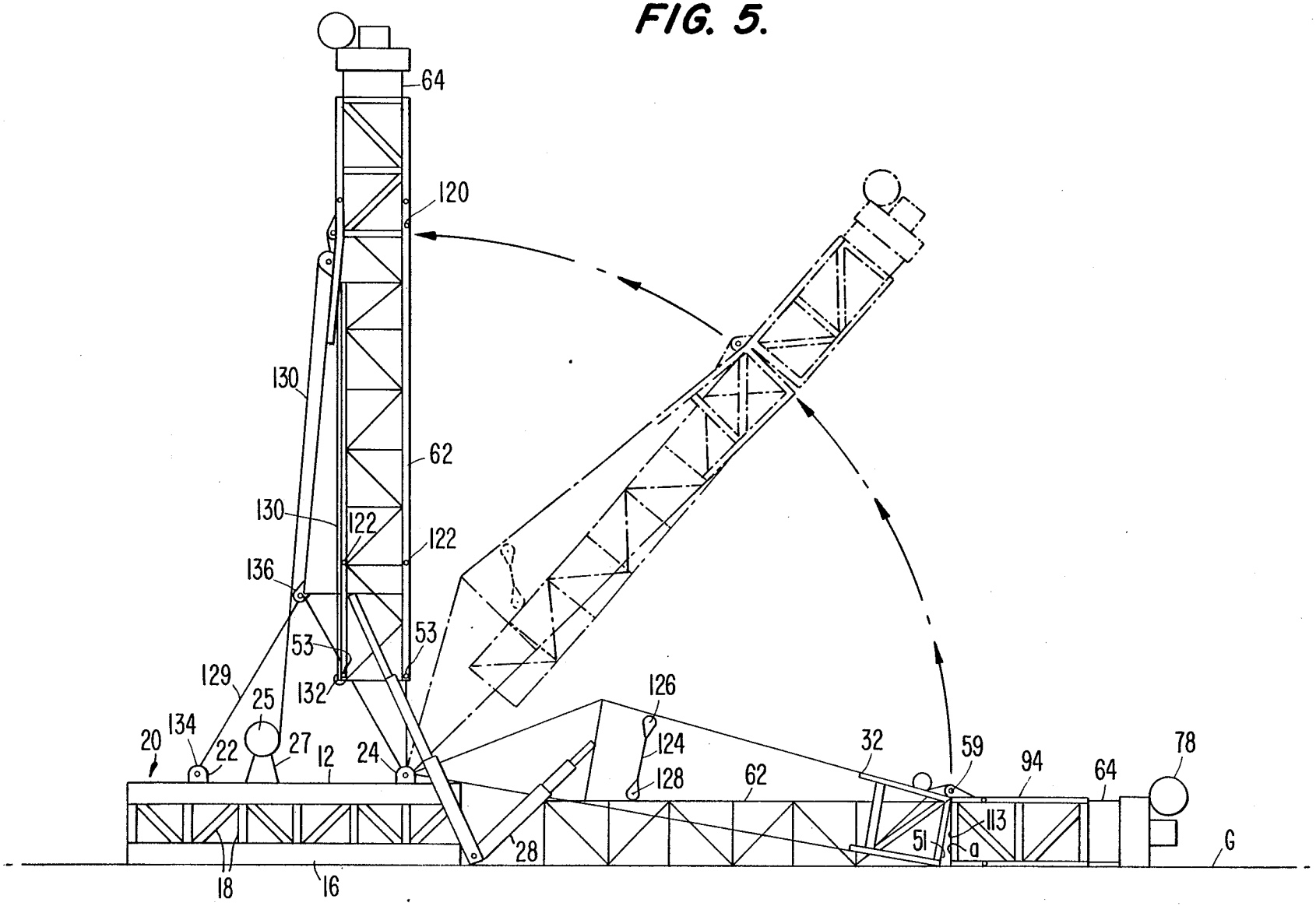
FIG. 5 is a side elevational schematic view of the drilling derrick assembly showing the mast of the present invention in the third position, still horizontal, and illustrating the angle between the bottom mast section and the pivoting guide assembly while the mast is horizontal and the intermediate position of the mast in phantom lines as it is raised towards the vertical with the use of the tether and as shown in the solid lines in the upright fourth position, the telescoped mast is vertical.
Figure 6:
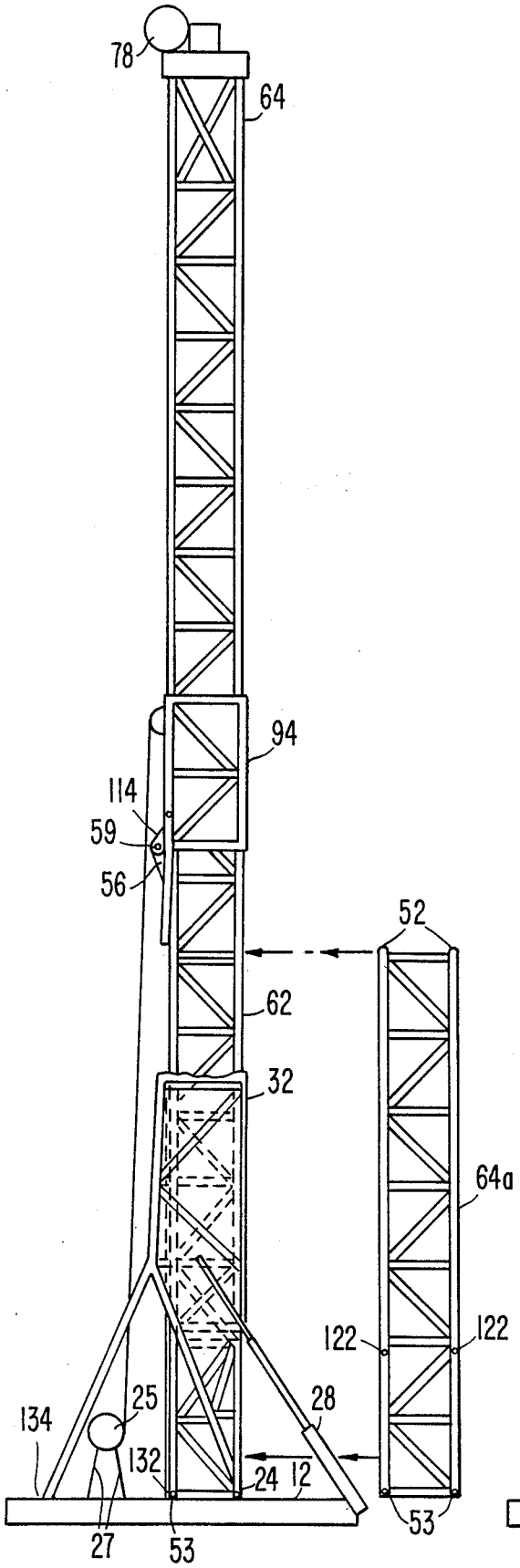
In FIG. 6 there is shown a schematic drawing partly exploded in side elevation, the mast being in a fifth vertical position wherein one of the intermediate upper sections has already been telescopically raised, and as shown in an adjacent position, the final upper intermediate section located ready for telescopic raising to a sixth position.
Figure 7:
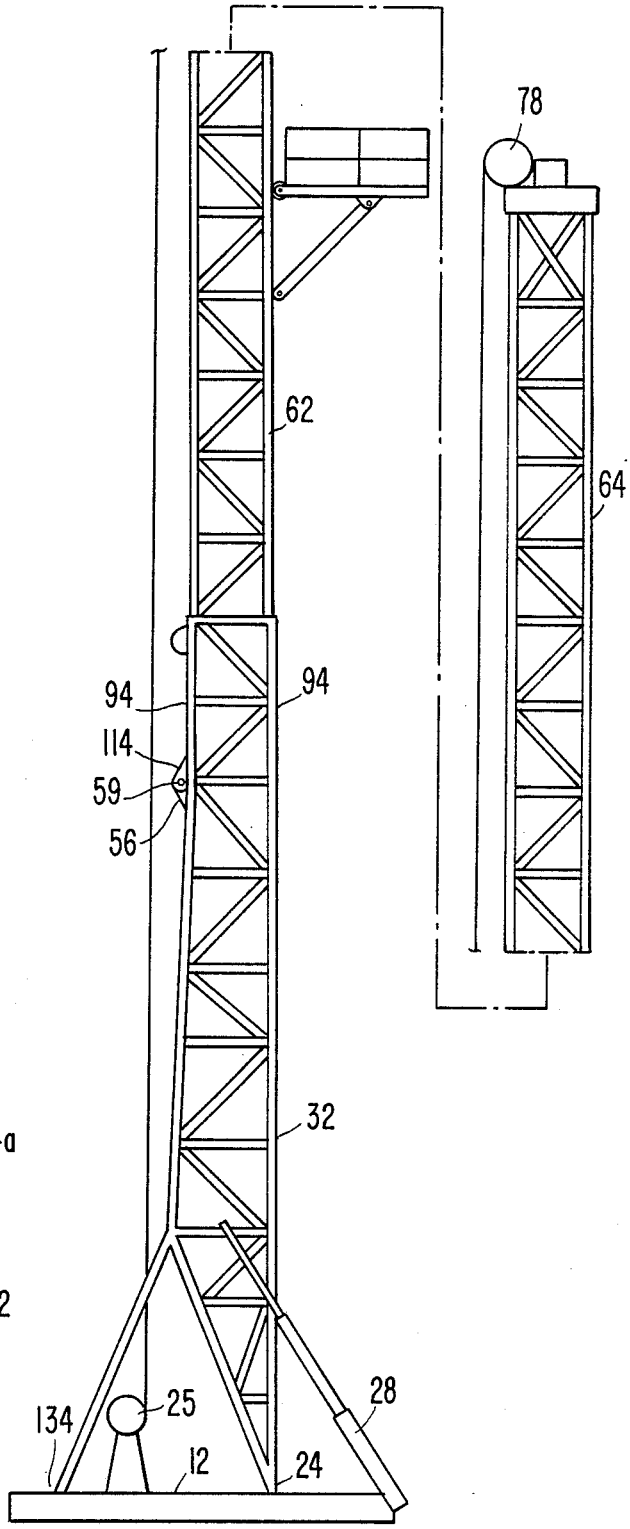
In FIG. 7 there is shown the side elevation partly broken away of the fully assembled drilling derrick in the seventh and final position wherein mast is vertical and ready for operation.

The present invention is illustrated principally in FIGS. 1, 3, 5 and 6 with FIG. 7 disclosing the final assembled position of the telescopic drilling derrick apparatus fully assembled and in vertical final position ready for operation. In FIG. 1, particularly, there is shown, in a first position, the schematic view, partly in phantom lines, of the drilling derrick assembly 10 of the present invention. The drilling derrick assembly 10 is shown schematically with a number of the wellknown features that are conventional not being shown in detail inasmuch as they do not constitute any part of the present invention. The assembly 10 does include a substructure 12 that should be portable and may include wheels, not shown, or else could be positioned on a truck also not shown. The particular means of moving the substructure is not therefore a feature of the present invention.

Figure 3:
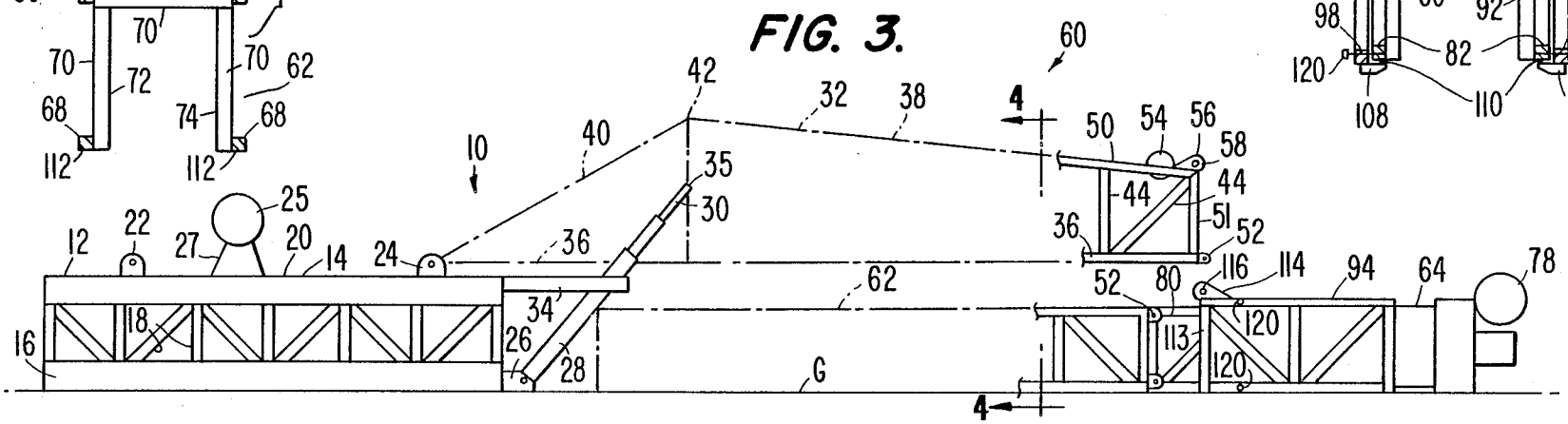
FIG. 3 is a schematic exploded view similar to that of FIG. 1 and illustrating the present invention partly in phantom lines showing the positioning of the bottom mast section above the upper in a second step of assembly.

The substructure 12 is composed of a plurality of steel rails both upper and lower pairs 14 and 16 respectively and suitable bracing 18 is positioned between the upper and lower rails 14 and 16 to hold and support rail 14 on the near side as shown in FIG. 1. A similar structure exists on the far side, not shown, between which are suitable plates forming a horizontal platform 20, all in the conventional manner. Secured to the platform 20 are conventional dog ears in pairs at 22 and at 24. The dog ears are secured as by welding or other suitable means to the platform 20. Also secured on the platform 20 is a draw works drum 25 supported in the usual fashion at 27 on the platform 20. Secured to the front and rear, as viewed in FIG. 1, lower rails 16 are support ears 26 to receive and secure the lower portion of a pair of rams 28,28 that have extension capabilities, the piston end of which at 30 is to be connected to the bottom mast section 32 as shown in FIGS. 3 and 5 particularly. The bottom of the rams 28 are pivotally secured in the support ears 26 at one end and at the upper end in resting position, the ram is held as shown in FIGS. 1 and 3 by removable arm 34 extending from platform 20 to hold the rams 28 in ready position to receive the bottom mast section 32.

Considering FIGS. 1 through 4 it can be seen that in FIG. 1 the parts of the drilling derrick assembly 10 are disposed ready for assembly after they have been removed from a truck or helicopter or the like and are laid horizontal on the ground G. In FIG. 3 the bottom mast section 32 is shown to be connected for pivotal movement to the dog ears 24 and is raised and lowered by means of the rams 28,28 connected to the bottom mast section at 35 to the piston end 30 of the ram. The bottom mast section 32 is of conventional design in that it is composed of a pair of lower frame legs 36,36 and upper frame legs 38,38 and lower frame legs 40,40 that meet at an angle as shown at 42. Conventional cross-bracing of the bottom mast section is shown at 44 to form side faces 46 and 48. Similar cross-bracing 44 also forms backface 50. At the upper end 51 of the bottom mast section 32 there is located a pair of connecting ears 52,52 that extend from the frame legs 36,36 as shown in FIG. 3. Also secured to the upper end of the bottom mast section 32 is telescopic line pulley 54 onto which is reeved a telescopic line for raising and lowering other mast sections, as will be described hereinafter. Also positioned at the upper end of the bottom mast section so as to extend beyond the backface 50 are pivot ears 56, 56 with a suitable bore 58 in each of the pivot ears 56 for receipt of a pivot rod 59.

Figure 4:
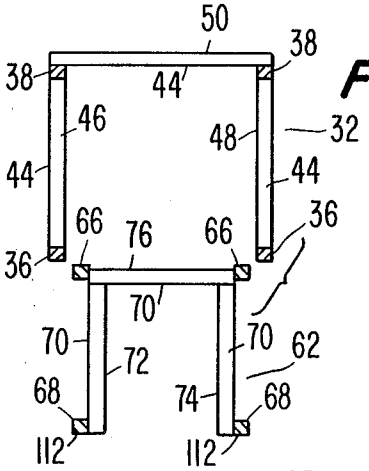
FIG. 4 is a cross-sectional view of the bottom mast section and the upper mast section taken along lines 4—4 of FIG. 3.

As shown in FIGS. 3 and 4, the bottom mast section has an open side between the frame legs 36 as best shown in FIG. 4 and the bottom mast section 32 is secured at 24 for pivotal movement to raise from the horizontal position shown in FIG. 3 to a vertical position as shown in FIG. 5 upon the action of the rams 28.

Figure 2:
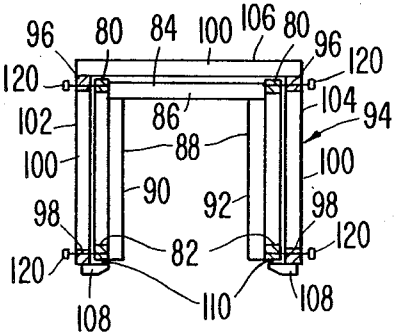
FIG. 2 is a cross-sectional view taken along lines 2—2 of FIG. 1 and illustrating the nesting or telescopic arrangement of the upper mast section within the pivoting guide assembly.

The additional sections of the mast, shown generally at 60, that would include not only the bottom mast section 32 but intermediate upper mast section 62 and top upper mast section 64 as can be seen in FIGS. 1 and 3 along with complementary FIGS. 2 and 4. Mast sections 62 and 64 are constructed similarly to that of the bottom mast section described in that they are provided with upper and lower pairs of frame legs 66 and 68. The mast sections 62 and 64 however differ from the bottom mast section 32 in that the raising assembly between the frame legs 66, 66 and 68, 68 are recessed as best shown in FIG. 4 to form recessed side faces 72 and 74 and recessed backface 76. As best seen in FIG. 4, the width of the backface 76 and the upper frame legs 66, 66 and lower frame legs 68, 68 is less than the opening between the frame legs 36, 36 of the bottom mast section so that the bottom mast section 32 would be capable of receiving or nesting over the mast section 62 for guided telescopic movement when in the upright or vertical position, as will be hereinafter described.

The top most upper section, may be referred to as top section 64, is the top of the mast 60 and is provided as shown with a conventional pulley 78 used only for the drilling or other derrick operations and not for purposes of the present invention to raise or lower the mast. The top mast section 64 is formed in an identical manner to the section 62, which constitutes an intermediate section forming the mast 60. The top mast section is provided with upper frame legs 80 in a pair as best shown in FIG. 2 similar to frame legs 66, 66 of the intermediate section 62. In addition lower frame legs 82, 82 are provided on the top mast section and are similar to the frame legs 68, 68 previously described. The bracing 84 forming the recessed back side 86 and the bracing 88 on each side to form the side faces 90 and 92 that are recessed from the upper frame legs 80 and the lower frame legs 82 as clearly shown in FIG. 2.

An important facet of the present invention is the utilization of a pivoting guide assembly 94 that is best shown in FIGS. 1 through 5. The pivoting guide assembly may be U-shaped in cross-section as shown in FIG. 2 having an open side at the bottom, or may be closed on all sides. The pivoting guide assembly is constructed somewhat similarly to the mast sections previously described in that there is a pair of upper frame legs 96 and a pair of similar lower pivoting guide frame legs 98. The bracing 100 forming sides 102 and 104. Similar bracing 100 also forms back face 106 and could also be used to enclose the end across frame legs 98.

As is apparent from FIG. 2, the interior of the pivoting guide assembly 94 is flush with the frame legs 96,96 and 98,98. In other words, the sides 102 and 104 and backface 106 are not recessed as is the construction of the mast sections 62 and 64. The purpose of this difference is to permit the pivoting guide assembly 94 have received therein the upper sections of the mast 60 in a guided, sliding telescopic fashion.

As shown in FIG. 2, the underside of the lower frame legs 98,98 is provided with a foot plate on each side as shown at 108. The foot plate has a portion extending outwardly towards the opposite leg and an upper sliding surface on each foot plate at 110 in order to receive the underside of the lower frame legs 82,82 or slidably receive the underside 112,112 of the lower frame legs 68 when that mast section is in contact with the pivoting guide assembly 94. The purpose of the foot plate 108,108 is to receive and hold in place the mast section when the mast section is pivotally raised toward the vertical. At the end 113 of the pivoting guide assembly there is provided a pair of complementary pivot ears 114,114 and secured to the backface of the pivoting guide assembly 94 proximal to the bottom mast section. The pivot ears 114,114 face toward and are operable with the pivot ears 56 to receive the pivot rod 59 into complementary bore 58 in the pivot ears 56,56 and the bores 116,116 in each one of the pivot ears 114 as best shown in FIG. 5. This construction permits pivotal movement between the pivoting guide assembly 94 and the bottom mast section 32.

The upper mast sections 62 and 64 are connected by means of securers in the form of connecting ears 52 or other means secured to the upper end of a lower mast section in bores 53,53 such as that shown to receive complementary pins 120 therethrough to lock the sections in place. Similarly as shown in FIGS. 1, 2 and 3 pins 120 forming connectors lock pivoting guide assembly 94 to the top mast section 64 through cooperative bores in the corresponding frame legs of the pivoting guide assembly 94 and the top mast section 64. Any similar means may be used as connectors. The appropriate bores to receive pins 120 are provided towards, but above, the lower end of each mast section such as may be shown better in FIG. 5 at 122,122. These bores 53,53 and 122,122 are positioned on each pair of upper and lower frame legs of every mast section above the bottom mast section so as to permit the mast sections to be held with pins 120 between adjacent mast sections and within the pivoting guide assembly 94 respectively. It should be understood, that when the pivoting guide assembly 94 is pinned with connectors 120 to the bottom mast section 32, the two structures become rigid and act as a unitary bottom mast structure.

Another important feature of the present invention is now apparent as attention is directed to FIG. 5 for the connection between the end 51 of the bottom mast section 32 and the end 113 of the pivoting guide assembly 94 by reason of the mating of the pivot ears 56,56 on the bottom mast section and the pivot ears 114,114 on the pivoting guide assembly 94. As shown in FIG. 5 pivot rod 59 connects the pairs of pivot ears locking the bottom mast section and the pivoting guide assembly in a pivoting relationship at the back side of each of the bottom mast section and the pivoting guide assembly. The particular advantage of the construction of the present invention as shown in FIG. 5 is that mast sections such as 62, 64 may be positioned horizontal and in contact with the ground G rather than be supported by a derrick or other equipment used for assembling the apparatus.

As shown in FIG. 5, the bottom mast section 32 is pivotally connected at 24 at one end and at the distal end the pivotal connection with pivot rod 59 to pivoting guide assembly 94 is achieved. The advantage to this arrangement is that the mast sections on the ground do not have to be raised to be nested within the bottom mast section but rather the connection is complete when the pivot rod 59 is passed through the appropriate pairs of pivot ears to form an angle a between the top end 51 of the bottom mast section and the bottom end 113 of the pivoting guide assembly, as shown in FIG. 5. The angle a is an acute angle measured between the end 113 of the pivoting guide assembly 94 and the end 51 of bottom mast section 32. Permitting this angle to occur enables the connection to be made quickly and easily. The pivoting guide assembly 94 holds the mast sections 62 and 64 by reason of the foot plates 108 at the bottom of the pivoting guide assembly even though the bottom mast section 32 is connected at an angle. This feature is a great time and effort saving structure.

Another feature of the present invention is a holder in the form of a tether 124. This tether may be in the form of a chain link or wire rope having suitable connecting means between the inside of an upper frame leg of the bottom mast, as shown at 126, and at the other end 128 of the tether there is connection with the backface 76 of the upper mast section 64 as by any convenient securing means, not shown.

Thus, upon the activation of the rams 28 on the bottom mast section 32 as shown in FIG. 5 the bottom mast section is forced pivotally to rise while the angle a gradually decreases slightly, as indicated in the phantom lines in FIG. 5. Actually, the phantom line showing in FIG. 5 is slightly exaggerated for viewing purposes and it is not until the ram powers the mast to the vertical position, as shown to the left of FIG. 5 is the angle a reduced to substantially zero where in fact it is not shown discernibly in the figure on the left hand side of FIG. 5. During the movement from the horizontal position towards the vertical position the tether 124 holds the top mast section 64 in an approximate nesting position rather than allowing the end of the top mast section 64 closest to the substructure 12 from dropping further out from the nesting position as the bottom mast section 32 is raised by the rams 28. In the vertical position, the rear leg 129 is secured at 134 and 136 to the substructure 12 and the bottom mast section respectively.

It should be obvious that the force required to be exerted by the rams 28 to raise the foreshortened mast from the horizontal position shown in FIG. 5 to the vertical position would be considerably less than if the mast had been fully extended while in a horizontal position, as is conventional in the prior art. This advantage of the present invention is brought about by the construction of the pivoting guide assembly 94 and its coaction with the telescopically received mast sections 62 and 64 as well as the coaction with the bottom mast section that connects with the pivoting guide assembly to permit a small acute angle to exist therebetween. The bottom mast section 32 is preferably much shorter than conventional bottom mast sections because the total desired height can be achieved by adding new mast sections such as shown at 64*a*. This foreshortened bottom mast section therefore aids in minimizing the weight to be raised and yet does not limit the vertical height required.

Once the mast 60 is in the vertical position as shown in the left hand figure of FIG. 5, the bottom mast section 32 is coupled to the pivoting guide assembly 94 at 52 and 53 with pins 120 to form a unitary structure. The mast sections then can be raised telescopically through the stationary bottom mast section and pivoting guide assembly.

To raise the mast sections telescopically through the bottom mast section 32 and the pivoting guide assembly it is merely necessary to utilize the draw works drum 25 and the telescopic line pulley 54 around which is reeved the telescopic line 130, as best shown in FIG. 5 to act as a lifter for the mast sections. This telescopic line connects at 132 to the bottom of the upper mast section 64 as well as succeeding lower mast sections, as shown in FIG. 6 at 64*a*. The telescopic line 130 is drawn taut by the draw works drum 25 with the connection 132 at the end of the telescopic line to the bottom of the mast section 64. The pins 120 or connectors holding the top mast section 64 within the pivoting guide assembly 94 can then be removed, the tether released, and the mast section 62 can be telescopically raised through the bottom mast section 32 and both mast sections 62 and 64 are raised through the pivoting guide assembly 94. As the telescopic line draws the mast sections vertically through the pivoting guide assembly 94 to a point where the bores 122 on the upper mast section 64 are coincident with the bores in the pivoting guide assembly that previously held pins 120, the pins 120 may be reinserted thus holding the mast section 62 in its raised vertical position to essentially the location where the bottom of the mast section 64 had been prior to having the mast sections raised by the telescopic line. Thereafter, when in that position as shown in FIG. 6 the succeeding mast section 64*a* can be inserted and secured to the bottom of the raised upper mast section 64 through the securers forming the connection therebetween and utilizing particularly connecting ears 52 and complementary bores 53 in the upper section and being secured as by pins 120. The telescopic line may be removed at its connection with mast section 64 at 132 when the pins 120 in the pivoting guide assembly 94 hold the upper mast section 64 in place. The telescopic line is reconnected again at 132 on the bottom of section 64*a* and the process repeated as the telescopic line is drawn taut to raise new higher section 64*a* to its raised position as shown in FIG. 7. The process may be repeated to attain the desired height of the drilling derrick assembly utilizing additional mast sections 64*b* and 64*c* etc. (not shown).

The objects of the present invention are believed to be met by the present description of the invention and the claims define the limits of the scope of protection sought.

Therefore, I claim:

1. A telescopic drilling derrick apparatus comprising:

a substructure, a bottom mast section pivotally connected at a lower end to said substructure, power means for moving said bottom mast from a substantially horizontal position to a vertical position, at least one upper mast section for vertical positioning above said bottom mast section when said bottom mast section is vertical, said bottom mast section being open on at least one side and being sized to receive therewithin said upper mast section, a guide assembly for connection to said bottom mast section, said guide assembly being sized to receive telescopically therewithin said upper mast section, support means positioned on said guide assembly for securing said upper mast section for longitudinal movement within said guide assembly and for supporting an upper mast section upon being raised toward a vertical position, said connection between said guide assembly and said bottom mast section including a pivot positioned axially distal to said lower end of said bottom mast section when in said horizontal position, the structure and arrangement being such that said bottom mast is capable of extending downwardly to receive therewithin a horizontal upper mast and be pivotally connected to and raise said guide assembly with the telescopically positioned therewithin upper mast section whereby to permit the pivotal raising of the upper mast section, while being within the bottom mast section, to a vertical position, and thereafter telescopically raising said upper mast section through said bottom mast section.

2. The drilling derrick apparatus of claim 1 including, a holder positioned between said bottom mast section and said upper mast section operative to secure the position of said upper mast section.

3. The drilling derrick apparatus of claim 2 including, said holder being a teather tying said upper mast section to said bottom mast section during the raising of said derrick apparatus.

4. The drilling derrick apparatus of claim 3 including, said teather being secured at one end to a side of said bottom mast section opposite to said open side and at the other end to said upper mast section.

5. The drilling derrick apparatus of claim 1 including, said guide assembly having a back face and a pair of side faces that are adapted to substantially enclose said upper mast section.

6. The drilling derrick apparatus of claim 5 including,
said pivot being secured to the lower end of said back face on said guide assembly and the upper end of said bottom mast section to allow the respective open ends of said bottom mast section and said guide assembly to separate in said horizontal position.

7. The drilling derrick apparatus of claim 1 including,
said pivot being formed from a plurality of ears secured to said guide assembly and said bottom mast section respectively and a pivot rod passing through said ears.

8. The drilling derrick apparatus of claim 1 including,
said guide assembly being essentially U-shaped in crosssection having a back face and a pair of side faces that are adapted to substantially enclose said lower mast section,
said pivot being secured to the lower end of said back face on said guide assembly and the upper end of said bottom mast section to allow the respective open ends of said bottom mast section and said guide assembly to separate in said horizontal position, and
said pivot being formed from a plurality of ears secured to said guide assembly and said lower mast section respectively and a pivot rod passing through said ears.

9. The drilling derrick apparatus of claim 1 including,
said guide assembly being of substantially shorter axial length compared to said upper mast section.

10. The drilling derrick apparatus of claim 1 including,
said support means on said guide assembly being proximal to said open side.

11. The drilling derrick apparatus of claim 1 including,
said support means on said guide assembly being a foot projecting into said open one side.

12. The drilling derrick apparatus of claim 11 including,
said foot extending longitudinally along a substantial length of said guide assembly.

13. The drilling derrick apparatus of claim 12 including,
said foot having an upper surface supporting said upper mast section for longitudinal relative movement between said guide assembly and said upper mast section.

14. The drilling derrick apparatus of claim 1 including,
said upper mast section being provided with a plurality of frame legs for alignment contact with the interior of said guide assembly, said upper mast section having a back face and side faces secured between said frame legs.

15. The drilling derrick apparatus of claim 14 including,
said back face and said side faces being recessed from said frame legs within said upper mast section so as to project said frame legs outwardly to align said upper mast section within said guide assembly.

16. The drilling derrick apparatus of claim 14 including,
said frame legs including back face frame legs and a lower frame leg adjacent the end of each of the side faces of said upper mast section and being in contact with said support means to permit said longitudinal movement.

17. The drilling derrick apparatus of claim 1 including,
said upper mast section being provided with a plurality of frame legs for alignment contact with the interior of said guide assembly, said upper mast section having a back face and side faces secured between said frame legs,
said frame legs including back face frame legs and a lower frame leg adjacent the end of each of the side faces of said upper mast section and being in contact with said support means to permit said longitudinal movement, and
said support means on said guide assembly being a foot projecting into said open one side.

18. The drilling derrick apparatus of claim 1 including,
said upper mast section being provided with a plurality of frame legs for alignment contact with the interior of said guide assembly, said upper mast section having a back face and side faces secured between said frame legs,
said frame legs including back face frame legs to a lower frame leg adjacent the end of each of the side faces of said upper mast section and being in contact with said support means to permit said longitudinal movement,
said support means on said guide assembly being a foot projecting into said open one side, and
said foot extending longitudinally along a substantial length of said guide assembly.

19. The drilling derrick apparatus of claim 1 including,
said upper mast section being provided with a plurality of frame legs for alignment contact with the interior of said guide assembly, said upper mast section having a back face and side faces secured between said frame legs,
said frame legs including back face frame legs to a lower frame leg adjacent the end of each of the side faces of said upper mast section and being in contact with said support means to permit said longitudinal movement,
said support means on said guide assembly being a foot projecting into said open one side,
said foot extending longitudinally along a substantial length of said guide assembly, and
said foot having an upper surface supporting said upper mast section for longitudinal relative movement between said guide assembly and said upper mast section.

20. The drilling derrick apparatus of claim 1 including,
a holder positioned between said bottom mast section and said upper mast section operative to secure the position of said upper mast section,
said holder being a teather tying said upper mast section to said bottom mast section during the raising of said derrick apparatus, and
said tether being secured at one end to a side of said bottom mast section opposite to said open side and at the other end to said upper mast section.

21. The drilling derrick apparatus of claim 1 including,
a holder positioned between said bottom mast section and said upper mast section operative to secure the position of said upper mast section, said holder being a teather tying said upper mast section to said bottom mast section during the raising of said derrick apparatus, said tether being secured at one end to a side of said bottom mast section opposite to said open side and at the other end to said upper mast section, and said guide assembly being essentially U-shaped in crosssection having a back face and a pair of side faces that are adapted to substantially enclose said upper mast section.

22. The drilling derrick apparatus of claim 1 including, said guide assembly being essentially U-shaped in crosssection having a back face and a pair of side faces that are adapted to substantially enclose said upper mast section, said pivot being secured to the lower end of said back face on said guide assembly and the upper end of said bottom mast section to allow the respective open sides of said bottom mast section and said guide assembly to separate angularly in said horizontal position, a holder positioned between said bottom mast section and said upper mast section operative to secure the position of said upper mast section, said holder being a teather tying said upper mast section to said bottom mast section during the raising of said derrick apparatus, and said tether being secured at one end to a side of said bottom mast section opposite to said open side and at the other end to said upper mast section.

23. The drilling derrick apparatus of claim 1 including, said guide assembly being essentially U-shaped in crosssection having a back face and a pair of side faces that are adapted to substantially enclose said upper mast section, said pivot being secured to the lower end of said back face on said guide assembly and the upper end of said bottom mast section to allow the respective open ends of said bottom mast section and said guide assembly to separate in said horizontal position, said pivot being formed from a of ears secured to said guide assembly and said lower ma respectively and a pivot rod passing through said ears, a holder positioned between said bottom mast section and said upper mast section operative to secure the of said upper mast section, said holder being a teather tying said mast section to said bottom mast section during the raising of said derrick apparatus, and said tether being secured at one to a side of said bottom mast section opposite to said open side and at the other end to said upper mast section.

24. The drilling derrick apparatus of claim 1 including, said guide assembly being essentially U-shaped in crosssection having a back face and a pair of side faces that are adapted to substantially enclose said upper mast section, said pivot being secured to the lower end of said back face on said guide assembly and the upper end of said bottom mast section to allow the respective open sides of said bottom mast section and said guide assembly to separate in said horizontal position, said pivot being formed from a plurality of ears secured to said guide assembly and said bottom mast section respectively and a pivot rod passing through said ears, a holder positioned between said bottom mast section and said upper mast section operative to secure the position of said upper mast section, said holder being a tether tying said upper mast section to said bottom mast section during the raising of said derrick apparatus, said tether being secured at one end to a side of said bottom mast section opposite to said open side and at the other end to said upper mast section, said upper mast section being provided with a plurality of frame legs for alignment contact with the interior of said guide assembly, said upper mast section having a back face and side faces secured between said frame legs, said frame legs including back face frame legs and a lower frame leg adjacent the end of each of the side faces of said upper mast section and being in contact with said support means to permit said longitudinal movement, and said support means on said guide assembly being a foot projecting into said open one side.

25. The drilling derrick apparatus of claim 1 including, a holder positioned between said bottom mast section and said upper mast section operative to secure the position of said upper mast section, said holder being a tether tying said upper mast section to said bottom mast section during the raising of said derrick apparatus, said tether being secured at one end to a side of said bottom mast section opposite to said open side and at the other end to said upper mast section, said guide assembly being essentially U-shaped in crosssection having a back face and a pair of side faces that are adapted to substantially enclose said upper mast section, said pivot being secured to the lower end of said back face on said guide assembly and the upper end of said bottom mast section to allow the respective open sides of said bottom mast section and said guide assembly to separate in said horizontal position, said pivot being formed from a plurality of ears secured to said guide assembly and said bottom mast section respectively and a pivot rod passing through said ears, said upper mast section being provided with a plurality of frame legs for alignment contact with the interior of said guide assembly, said upper mast section having a back face and side faces secured between said frame legs, said frame legs including back face frame legs and a lower frame leg adjacent the end of each of the side faces of said upper mast section and being in contact with said support means to permit said longitudinal movement, said support means on said guide assembly being a foot projecting into said open one side, said foot extending longitudinally along a substantial length of said guide assembly, and said foot having an upper surface supporting said upper mast section for longitudinal relative movement between said guide assembly and said upper mast section.

26. A method of erecting a drilling derrick apparatus having an upper mast section and a bottom mast section pivotally connected at one end to a substructure comprising, laying said upper mast section substantially horizontal, telescopically receiving said upper mast section within a surrounding guide member, lowering said bottom mast section to surround a portion of said upper mast section, pivotally connecting said guide member to said bottom mast section on one side, forming an acute angle between the end of said bottom mast section and the end of said upper mast section when substantially horizontal, raising said bottom mast section towards the vertical while decreasing said angle to essentially zero at a vertical position, maintaining a nesting relationship between said bottom mast section and said upper mast during said raising at least one to a vertical position, thereafter telescopically raising said upper mast section through and above said bottom mast section, and securing said upper mast section to said bottom mast section to form a vertical apparatus.

27. The method of claim 26 including, releasably securing said upper mast to said surrounding guide member.

28. The method of claim 26 including, holding said bottom mast section to said upper mast section during said raising of said bottom mast structure.

29. The method of claim 26 including, releasably securing said upper mast to said surrounding guide member, and holding said bottom mast section to said upper mast section during said raising of said bottom mast structure.

* * * * *